US011150061B1

(12) United States Patent
Broussard

(10) Patent No.: US 11,150,061 B1
(45) Date of Patent: Oct. 19, 2021

(54) ARROW NOCK ASSEMBLY

(71) Applicant: Mary Broussard, Colorado Springs, CO (US)

(72) Inventor: Mary Broussard, Colorado Springs, CO (US)

( * ) Notice: Subject to any disclaimer, the term of this patent is extended or adjusted under 35 U.S.C. 154(b) by 0 days.

(21) Appl. No.: 17/065,745

(22) Filed: Oct. 8, 2020

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS 2,484,589 A * 10/1949 Richards ..... F42B 6/06 473/578
2,581,884 A * 1/1952 Ringel ..... F42B 6/06 473/578
4,305,588 A 12/1981 Dodge
4,544,163 A 10/1985 Scanlon
5,067,731 A * 11/1991 Bickel ..... F42B 6/06 473/578
5,186,470 A 2/1993 Easton
6,203,457 B1 * 3/2001 Snook ..... F42B 6/06 473/586
6,595,880 B2 7/2003 Becker
D702,802 S 4/2014 Marshall, Jr.
9,702,671 B2 * 7/2017 Minica ..... F42B 6/06
10,393,484 B2 * 8/2019 Bednar ..... F41B 5/148

FOREIGN PATENT DOCUMENTS

GB 2267043 11/1993

* cited by examiner

*Primary Examiner* — John A Ricci

(57) ABSTRACT

An arrow nock assembly for enhancing drawing an arrow shaft in a bow includes a nock that is attachable to an arrow shaft. The nock has a pair of indentations each being integrated into an outer surface of the nock. Each of the indentations enhances gripping the nock for drawing the arrow shaft in a bow. The nock has a string space therein and the string space has a twisted orientation enhance attaching the nock to the string of the bow.

6 Claims, 2 Drawing Sheets

ARROW NOCK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to nock devices and more particularly pertains to a new nock device for enhancing drawing an arrow shaft in a bow.

(2) Description of Related Art Including Information Disclosed Under 37 CFR 1.97 and 1.98

The prior art relates to nock devices including a variety of arrow nocks that each has scooped portions for enhancing gripping the arrow nocks. The prior art discloses a variety of arrow nocks that have protrusions thereon for enhancing gripping the arrow nocks.

BRIEF SUMMARY OF THE INVENTION

An embodiment of the disclosure meets the needs presented above by generally comprising a nock that is attachable to an arrow shaft. The nock has a pair of indentations each being integrated into an outer surface of the nock. Each of the indentations enhances gripping the nock for drawing the arrow shaft in a bow. The nock has a string space therein and the string space has a twisted orientation enhance attaching the nock to the string of the bow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
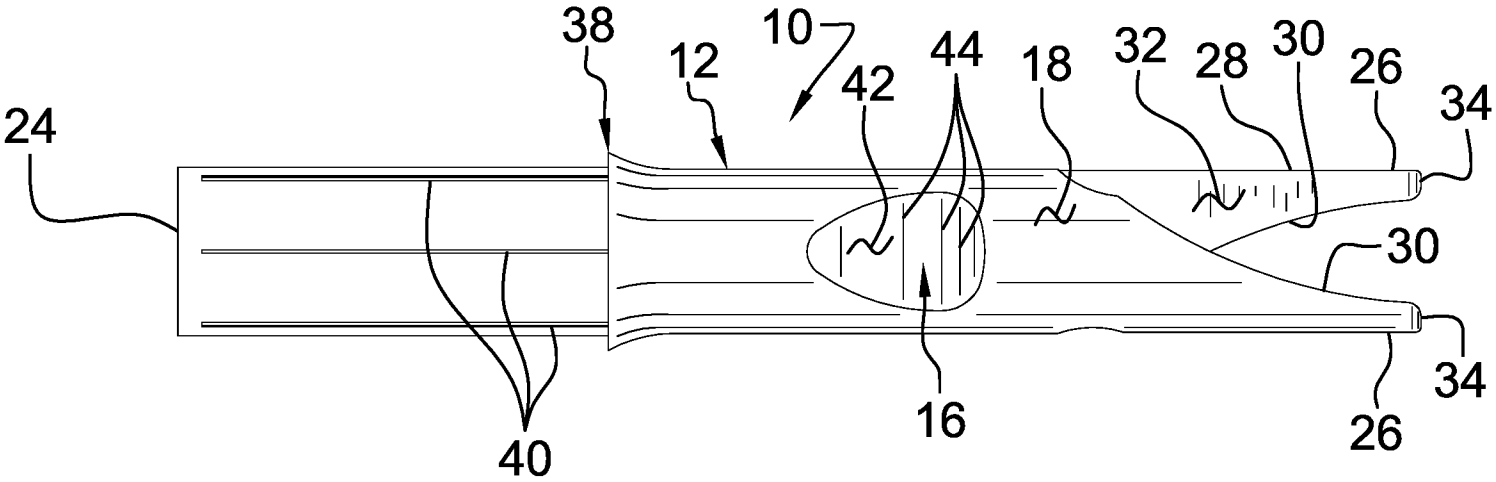
FIG. 1 is a right side view of an arrow nock assembly according to an embodiment of the disclosure.
Figure 3:
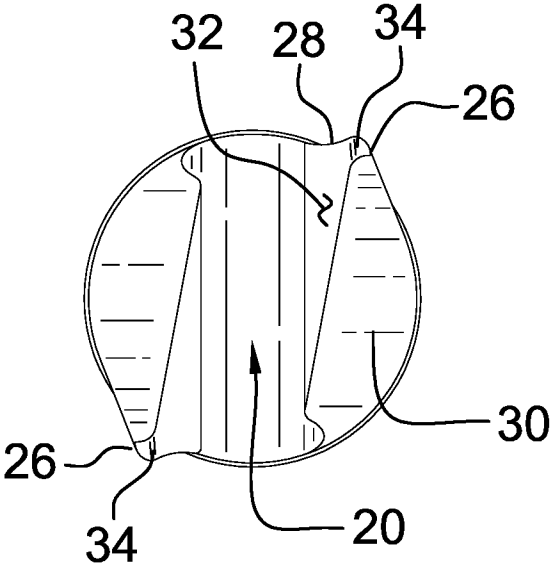
FIG. 3 is a back view of an embodiment of the disclosure.
Figure 2:
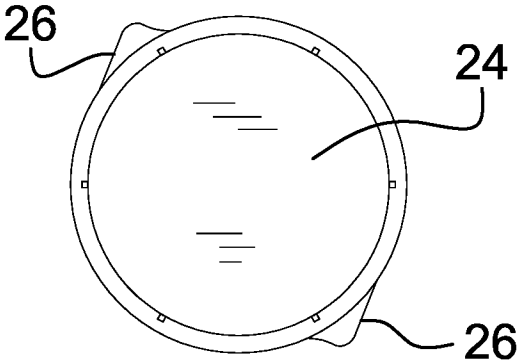
FIG. 2 is a front view of an embodiment of the disclosure.
Figure 4:
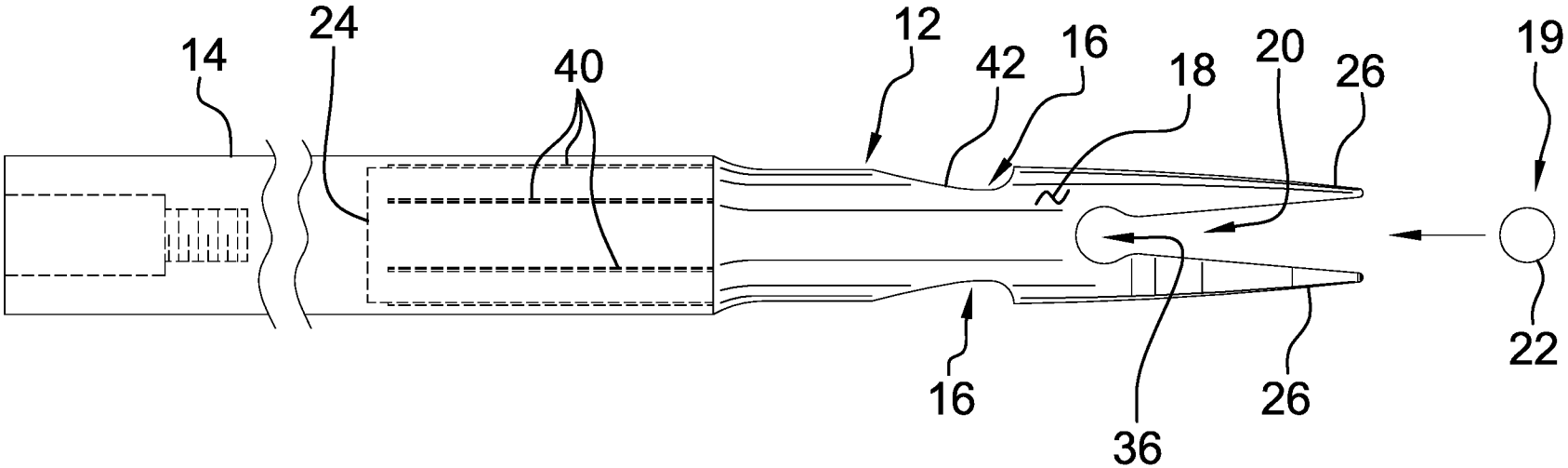
FIG. 4 is a perspective in-use view of an embodiment of the disclosure.

With reference now to the drawings, and in particular to FIGS. 1 through 4 thereof, a new nock device embodying the principles and concepts of an embodiment of the disclosure and generally designated by the reference numeral 10 will be described.

As best illustrated in FIGS. 1 through 4, the arrow nock assembly 10 generally comprises a nock 12 that is attachable to an arrow shaft 14. The nock 12 has a pair of indentations 16 each integrated into an outer surface 18 of the nock 12 to enhance gripping the nock 12 for drawing the arrow shaft 14 in a bow 19. The nock 12 has a string space 20 therein and the string space 20 has a twisted orientation. In this way the string space 20 enhances attaching the nock 12 to a string 22 of the bow 19.

The nock 12 has a first end 24 and the nock 12 includes a pair of fingers 26 each being disposed thereon. Each of fingers 26 has a first lateral side 28, a second lateral side 30, an inwardly facing surface 32 and a distal end 34 with respect to the first end 24 of the nock 12. The inwardly facing surface 32 of each of fingers 26 is directed toward each other to define the string space 20 between the fingers 26 for receiving the string 22 of the bow 19. The first lateral side 28 of each of the fingers 26 slopes outwardly with respect to the outer surface 18 of the nock 12. Thus, the distal end 34 of each of the fingers 26 is positioned outwardly beyond the outer surface 18 of the nock 12.

The second lateral side 30 of each of the fingers 26 curves toward an opposing finger 26. In this way the string space 20 follows a twisting path to facilitate the string space 20 to engage the string 22 regardless of the orientation of the fingers 26 with respect to the string 22. Thus, a user does not have to rotate the arrow shaft 14 in order to align the nock 12 with the string 22 on the bow 19 as is currently required with existing nocks. The inwardly facing surface 32 of each of the fingers 26 intersects in a concave arc to define a rounded portion 36 of the string space 20 that engages the string 22 on the bow 19. Additionally, the inwardly facing surface 32 of each of the fingers 26 slopes outwardly between the rounded portion 36 of the string space 20 and the distal end 34 of the respective finger 26.

The outer surface 18 has a fluted portion 38 that is positioned between the first end 24 and the fingers 26. Additionally, the outer surface 18 has a plurality of ridges 40 each extending outwardly therefrom to frictionally engage the arrow shaft 14 when the first end 24 of the nock 12 is inserted into the arrow shaft 14. Each of the ridges 40 extends between the fluted portion 38 and the first end 24. Additionally, the ridges 40 are spaced apart from each other and are distributed around the outer surface 18. Each of the ridges 40 may have a height of approximately 0.2 mm and a width of approximately 0.1 mm.

Each of the indentations 16 is positioned on opposing sides of the outer surface 18 with respect to each other and each of the indentations 16 is positioned between the fluted portion 38 and the fingers 26. Each of the indentations 16 has a bounding surface 42 and the bounding surface 42 slopes downwardly and then upwardly between the fluted portion 38 and the fingers 26. Additionally, the bounding surface 42 of each of the indentations 16 has a plurality of grooves 44 therein to enhance gripping each of the indentations 16.

In use, the first end 24 of the nock 12 is inserted into the arrow shaft 14 in the conventional manner of attaching a nock 12 to the arrow shaft 14. The twisting path of the string space 20 facilitates the string space 20 to engage the string 22 on the bow 19 without requiring the user to rotate the arrow shaft 14 for aligning the nock 12 with the string 22 as is currently required. Additionally, the indentations 16 in the outer surface 18 of the nock 12 enhance gripping the nock 12 for drawing the arrow shaft 14 in the bow 19.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An arrow nock assembly having gripping grooves integrated therein for enhancing drawing an arrow on a bow, said assembly comprising:

a nock being attachable to an arrow shaft, said nock having a pair of indentations each being integrated into an outer surface of said nock wherein each of said indentations is configured to enhance gripping said nock for drawing the arrow shaft in a bow, said nock having a string space therein, said string space having a twisted orientation wherein said string space is configured to enhance attaching said nock to the string of the bow;

wherein said nock has a first end, said nock including a pair of fingers each being disposed thereon, each of fingers having a first lateral side, a second lateral side, an inwardly facing surface and a distal end with respect to said first end of said nock, said inwardly facing surface of each of fingers being directed toward each other to define said string space between said fingers wherein said string space is configured to receive the string of the bow; and wherein said outer surface has a fluted portion being positioned between said first end and said fingers.

2. The assembly according to claim 1, wherein said first lateral side of each of said fingers sloping outwardly with respect to said outer surface of said nock such that said distal end of each of said fingers is positioned outwardly beyond said outer surface of said nock.

3. The assembly according to claim 1, wherein said second lateral side of each of said fingers curves toward an opposing finger Wherein said fingers are configured to facilitate said string space to engage the string regardless of the orientation of said fingers with respect, to the string.

4. The assembly according to claim 1, wherein said outer surface has a plurality of ridges each extending outwardly therefrom wherein said ridges are configured to frictionally engage the arrow shaft when said first end of said nock is inserted into the arrow shaft, each of said ridges extending between said fluted portion and said first end, said ridges being spaced apart from each other and being distributed around said outer surface.

5. The assembly according to claim 1, wherein each of said indentations is positioned on opposing sides of said outer surface with respect to each other, each of said indentations being positioned between said fluted portion and said fingers.

6. An arrow nock assembly having gripping grooves integrated therein for enhancing drawing an arrow on a bow, said assembly comprising: a nock being attachable to an arrow shaft, said nock having a pair of indentations each integrated into an outer surface of said nock wherein each of said indentations is configured to enhance gripping said nock for drawing the arrow shaft in a bow, said nock having a string space therein, said string space having a twisted orientation wherein said string space is configured to enhance attaching said nock to the string of the bow, said nock having a first end, said nock including a pair of fingers each being disposed thereon, each of fingers having a first lateral side, a second lateral side, an inwardly facing surface and a distal end with respect to said first end of said nock, said inwardly facing surface of each of fingers being directed toward each other to define said string space between said fingers wherein said string space is configured to receive the string of the bow, said first lateral side of each of said fingers sloping outwardly with respect to said outer surface of said nock such that said distal end of each of said fingers is positioned outwardly beyond said outer surface of said nock, said second lateral side of each of said fingers curving toward an opposing finger wherein said fingers are configured to facilitate said string space to engage the string regardless of the orientation of said fingers with respect to the string, said outer surface having a fluted portion being positioned between said first end and said fingers, said outer surface having a plurality of ridges each extending outwardly therefrom wherein said ridges are configured to frictionally engage the arrow shaft when said first end of said nock is inserted into the arrow shaft, each of said ridges extending between said fluted portion and said first end, said ridges being spaced apart from each other and being distributed around said outer surface, each of said indentations being positioned on opposing sides of said outer surface with respect to each other, each of said indentations being positioned between said fluted portion and said fingers.

* * * * *